United States Patent [19]

Becker et al.

[11] Patent Number: 4,821,654

[45] Date of Patent: Apr. 18, 1989

[54] REGENERATION OF BULK MATERIALS

[75] Inventors: Norbert Becker, Freudenberg; Michael Gross, Betzdorf-Dauersberg, both of Fed. Rep. of Germany

[73] Assignee: Forder-und Anlagetechnik GmbH, Niederfischbach, Fed. Rep. of Germany

[21] Appl. No.: 112,960

[22] Filed: Oct. 23, 1987

[30] Foreign Application Priority Data

Oct. 27, 1986 [DE] Fed. Rep. of Germany ..... 3636479

[51] Int. Cl.[4] ..... F23D 14/00

[52] U.S. Cl. ..... 110/236; 110/204; 110/245; 110/346; 241/DIG. 10

[58] Field of Search ..... 110/236, 346, 245, 204; 241/DIG. 10

[56] References Cited

U.S. PATENT DOCUMENTS

| | | | |
|---|---|---|---|
| 3,841,240 | 10/1974 | Wentworth et al. | 110/236 |
| 4,508,277 | 4/1985 | Andrews | 241/DIG. 10 |
| 4,628,838 | 12/1986 | Love | 110/245 |
| 4,648,332 | 3/1987 | Goedhart | 110/236 X |
| 4,667,609 | 5/1987 | Hardison et al. | 110/236 |
| 4,708,775 | 11/1987 | McGregor et al. | 110/236 X |

FOREIGN PATENT DOCUMENTS 3516191 4/1986 Fed. Rep. of Germany .

OTHER PUBLICATIONS

Ruzbehi, "Thermo-Mechanical Regeneration" *Industrie*, Nr. 26, 3/29/85, p. 32.

*Primary Examiner*—Edward G. Favors

*Attorney, Agent, or Firm*—Norman S. Blodgett; Gerry A. Blodgett

[57] ABSTRACT

In order to rationalize the operation of foundries and to avoid environmental stresses, it is endeavored so to rework used molding sand accruing as black sand and to free it from binder residue, so that this sand can be used without restriction like new sand. To achieve this aim through thermo-mechanical regeneration the black sand is heated in predetermined, relative low height layer in a fluidized bed furnace to a temperature exceeding 500° C., preferably 750° C. Through the swirling motions of the heated black sand, preferably supported through strong vibrations of the supporting base, the thermal destruction of the enveloping binder particles and a mechanical liberation of the sand grains form their enveloping binder remains is achieved. By means of a forced throughout (e.g. through appropriate vibrations or by means of a scraper conveyor) a uniform throughput with constant layer height is achieved which can be stabilized by means of additionally installed webs so that the desired mode of operation is ensured. By means of pre and post-treatment heat exchangers, the energy requirement can be kept low, while an appropriately high combustion temperature ensures at the same time the creation of environmentally safe oxidation products.

19 Claims, 2 Drawing Sheets

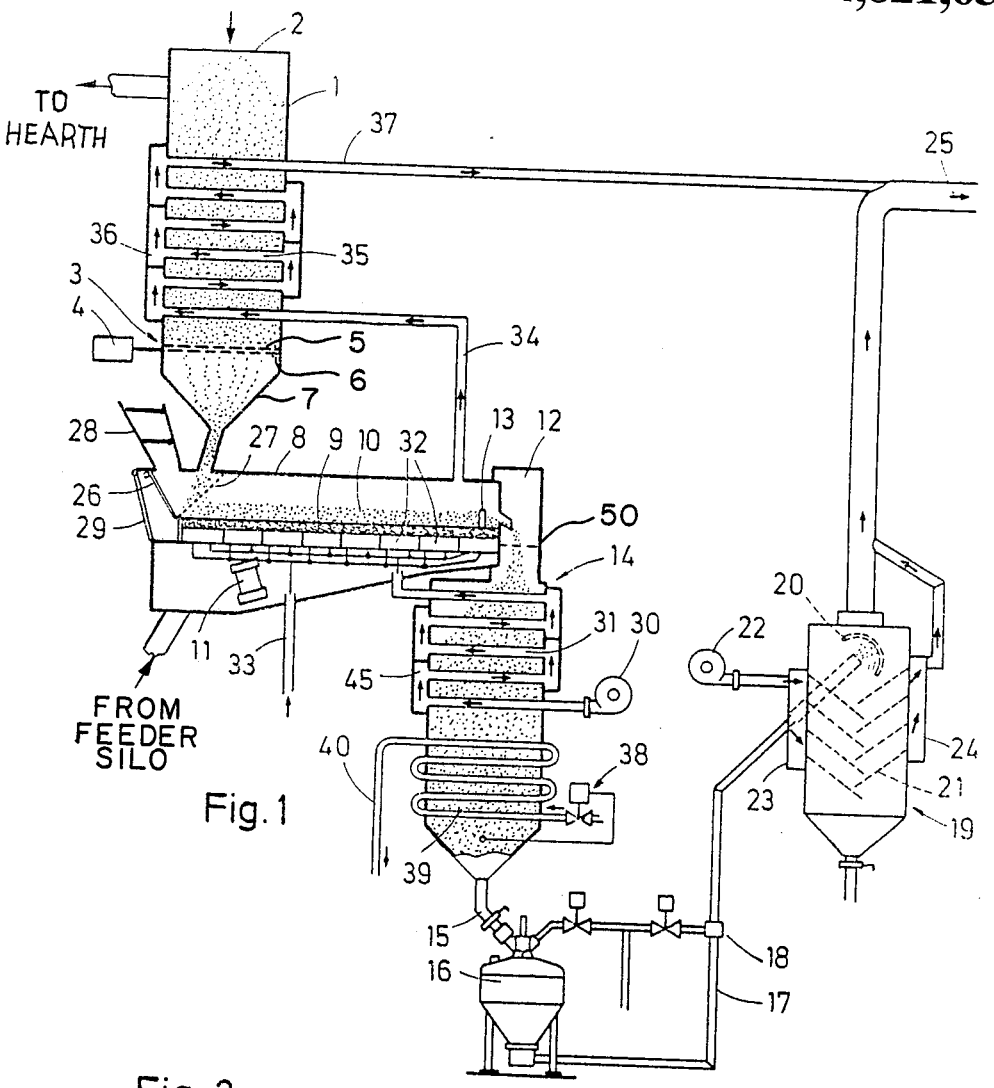
Fig. 1
Fig. 2
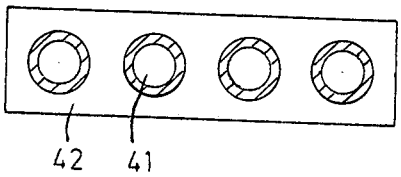
Fig. 3
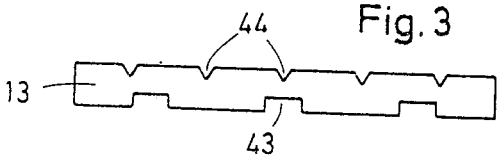

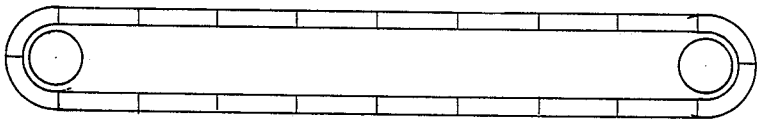
Fig. 4
Fig. 5
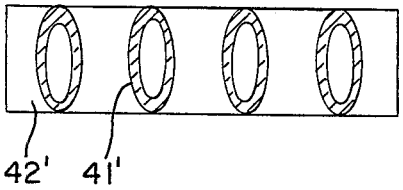

REGENERATION OF BULK MATERIALS

BACKGROUND OF THE INVENTION

The invention relates to a method for the thermo-mechanical regeneration of bulk material, especially of foundry black sand. The heating-up of the black sand that is to be regenerated is effected during its transport in a layer of low height. The invention also relates to arrangement for carrying out the method.

The molding sand used in foundries is used with additional components which help maintain the shape given to the sand. Such a molding sand can, however, at best be reused only in part. Both the acquisition of new sand and the disposal of "black" sand prove unfavorably expensive. In particular, the disposal of the black sand, for example by depositing it in dumps, is made increasingly difficult and expensive due to increasing concern for the environment.

*Industrie-anzeiger* No. 26 of Mar. 29, 1985, page 32 discloses known thermal, mechanical, wet-chemical and thermo-mechanical methods for the regeneration of black sand. However, in this article the thermal, mechanical and the wet-chemical methods are described as economically unjustifiable. This is because either the regeneration can only be carried out successfully when certain binders are present or only with an unreasonably high expense. Batch operation is recommended using a whirler tool in the form of a rotor in a closed container, in connection with an open flame. The flame grazes the surface of the bulk material and heats it to temperature of maximally 300° C. It was found that, in view of the achievable throughput, an unacceptably high expenditure is required. Furthermore, the desired removal of adhering binder cannot be achieved to the desired extent.

The DE-PS No. 35 16 191 recommends regenerating such bulk materials by sliding them in a dosed, thin layer across floors which allow a heating of the sliding bulk material by infrared rays. Such arrangements are praised as economical, small and compact and especially as flexible regarding the throughput. However, the heat attainable and the throughput capacity have found to be inadequate and uneconomical. The thermal destratification has also been carried on with the aid of fluidized bed furnaces with relatively large capacity. These methods, however, are expensive and only applicable for large amounts of throughput. Moreover, varying dwelltimes of the sand in the furnace arise which additionally reduces the profitability. Further, such fluidized bed furnaces do not guarantee trouble-free operation because heavy foreign bodies, especially casting spatter can settle, with increasing duration of operation, on the furnace bed.

It is a primary object of the invention to provide an efficient, economical arrangement of the kind described whose initial product can be used without restrictions like new sand.

SUMMARY OF THE INVENTION

The invention involves heating the black sand with a given layer height in a fluidized bed furnace equipped with forced output to a temperature exceeding 500° C., preferably 650° C. Such high temperature is able to remove the water of crystallization from crystalline binders and also to burn organic materials without residue so that the remains of the binder sticking to grains of the bulk material are totally destroyed. The forced throughput is not only able to remove binder remains sticking to grains of the bulk material without residue, but also to remove heavy admixtures such as casting spatter, gate parts or the like. These are reliably removed from the firebox of the fluidized bed furnace. Favorable and beneficial developments of the invention are characterized below.

BRIEF DESCRIPTION OF THE DRAWINGS

The features of the invention are explained in detail with the aid of the following description of an exemplary embodiment in connection with corresponding drawings. These show:

FIG. 1 a diagrammatic view of an arrangement for the regeneration of foundry sand, FIG. 2 a cross-section of one of the heat exchangers employed, FIG. 3 an elevation view of a hold-back web.

FIG. 4 is schematic view of a scraper conveyor, and

FIG. 5 is a view of an alternative shape for the heat exchanger tubes.

DESCRIPTION OF THE PREFERRED EMBODIMENT

In FIG. 1, a silo 1 is shown which serves to take up the old sand which is to be reconditioned. The silo can be closed after the receipt of a charge by means of a closure 2 in case closing off solely by the column of material is not considered sufficient. At its lower end is a dosing device 3 which has two perforated dosing plates 5 and 6, one above the other. At least one can be made to oscillate by means of a vibrator 4. This dosing device allows the metered removal of material from the silo 1. The material released from the dosing device 3 is discharged into the heating chamber of a fluidized bed furnace 8 through a closing funnel 7 so that it covers the heating chamber bottom 9 with a layer of material of predetermined height. The bottom 9 is made to oscillate by vibrators 11 in such a manner that the material is subjected to a loosening vertical acceleration. As shown to the right in the figure, the material is simultaneously slowly moved forward in direction toward a transfer device 12. The layer height is stabilized by means of one or several hold-back webs 13. Movement may be by a scraper conveyor as shown in FIG. 4. The transfer device 12 may be provided with sifters or screens 50.

In the transfer device 12 the sand drops down into a transfer silo 14 in which the sand is cooled down to a favorable processing temperature. The sand is fed through an outlet 15 into a pneumatic conveyor 16 and conducted, over a conveying line 17, to sifter 19. This conveying line 17 is provided with a accelerator nozzle 18 by which accelerated sand is blown into a baffle bell 20. By the impact, possible remainders of the burned binder are separated from the sand grains.

Sloping bottoms 21 are provided in the sifter through which the sand is guided downwards. By means of a blower 22 and a distributing air box 23, air is blown, as indicated by arrows, transversely through the sifter 19. Thus the heavy and compact grains of sand drop down but binder residue, dust and other light contaminations are conducted away through a collector 24 for the exhaust air. The latter are conducted to an exhaust air line and are conducted, in the direction of arrow 25, to a filter.

The sand introduced into the silo 1 is fed in doses by the opposite motions of the dosing plates 5 and 6 and is metered into the heating chamber of the fluidized bed furnace 8. Sand lumps and largish core parts are fed into the discharge funnel 28 which is preferably equipped with a material-sluice to prevent the escape of flue gases. The introduced lumps slide downwards over a slide 26 or an appropriate grate and lie in front of the grate 27 until the thermal decomposition has proceeded far enough that the liberated sand can pass through the narrow grates. Any metal parts which accrue can be removed from the furnace through the chamber door 29.

To achieve an economical operation, heat exchangers 31, 35, and 39 are provided in the upper and in the lower regions of the discharge silo 14.

The air required for combustion is drawn in by means of a blower 30 and forced through the heat exchangers 31 provided in the upper part of the discharge silo 14. The regenerated sand, discharged from the fluidized bed furnace 8 at for example about 750° C., is thus cooled, with the simultaneous heating of the furnace air to e.g. 200° to 300° C. The gas provided for firing is fed to the fluidized bed furnace through pipes 33. The preheated supply air is taken from the exchangers 31 of the discharge silo 14. Gas and combustion air are fed into chambers 32 provided below the porous bottom 9 and there become mixed to form a combustible gas mixture. This mixture passes through pore channels of the bottom 9 of the fluidized bed furnace 8. This can either be designed as a porous element or provided with openings or nozzles. Thus the combustion proceeds with minimum waste within the agitated material-layer 10 or above it, so that an effective heating up is achieved with high degree of efficiency.

The flue gases formed in the fluidized bed furnace 8 are conducted through a flue gas line 34 to a number of series-operated heat exchangers 35 which are arranged in the lower region (in the embodiment shown-in the lower two-thirds) of the silo 1. The flue gases are then conducted through a waste gas line 37 over a collector in direction of arrow 25, preferably via a filter, to a fireplace, a chimney or the like. On passing through the heat exchangers 35 the flue gases give off a substantial portion of their heat content in the counterflow. In this manner they heat the black sand located in the silo 1, which is to be regenerated, to e.g. 300° C. Thus the fluidized bed furnace is charged with material which has already been preheated to the usual maximum temperature which customary thermal methods impart to such material. Either by closing off the silo 1 by means of its closure 2 or (in the absence of such a closing device) simply by means of the sand masses accruing above the heat exchangers, the waste gases arising from this preheating are conducted through the funnel 7 into the heating chamber of the fluidized bed furnace 8. There they burn completely and, being removed with exhaust air, they can no longer be considered as endangering the environment.

Depending on the type of binder used, the optimal process temperature of molding sand lies at approximately 25° C. In the lower region of the discharge silo 14, therefore, additional heat exchangers 39 are provided which are intermingled with cooling water and which cool off the regenerated sand to the temperature recognized as advantageous.

In the FIG. 2 one of the heat exchangers 31, 35, or 39 respectively, is shown in cross-section. Several parallel pipes 41 are connected with a jointly heat-transferring metal sheet 42 so that large contact surfaces towards the sand is formed. In order to obtain, on the one hand, a large surface and cross-section to ensure the unhindered removal of the flue gases, and, on the other hand, not to impede the vertical flow of the bulk material in silo 1, the heat exchanger may also have pipes of an elliptical cross-section onto which the heat conducting sheets 42 are pressed and/or completely welded. Preferably the longer axis of the pipes is oriented vertically. The heat exchangers 31 and 35 can be constructed in a similar manner, especially the heat exchangers 39 through which cooling water flows. These may have pipes of smaller cross-section. The heat conducting sheets which establish the contact with the bulk material can be shrunk onto the pipe; however, it is also possible to wrap sheet metal strip spirally around the pipes in a known manner or alternatively to weld them to the base.

To facilitate the maintenance of the predetermined thickness of the material layer 11 it may prove advantageous to provide one or several hold-back webs 13 in the fireplace of the fluidized bed furnace 8, upon its bottom 9. These may have cutouts 44 on their upper surface. Essential, however, are cutouts 43 on the underside facing towards the bottom 9. These cutouts allow the through-passage of fluidizable material, e.g. casting spatter, ceramic particles etc., so that a clogging of the furnace hearth by such foreign bodies is reliably prevented. It has been found that e.g. 250° C. can be considered as the most favorable working temperature of the regenerated sand since at this temperature the binder neither binds (sets) too fast or too slow and proves particularly effective. The cooling is therefore preferably controlled in the discharge silo 14. A temperature sensor provided at the outlet picks up the actual value of the outlet temperature. A solenoid 38 is provided as regulating element of the control device, which solenoid allows the control to be carried out relatively simply and with little expense as a so-called twopoint-control; the cooling water is then conducted away through the waste water line 40.

In order not to overcrowd the drawing the cooling rivulets of the heat exchangers have not been depicted in the FIG. 1. Especially on the heat exchangers 31 and 35, through which air flows, the diversion from one heat exchanger to the higher located heat exchanger is preferably carried out through deflecting chambers 36 or 45. These deflecting chambers or, specifically, the surfaces of the chambers standing over the mouths of the respective heat exchanger, can be detachably designed so that the chambers can be easily cleaned (especially the heat exchangers 35, through which flue gases flow.).

Embodiments of the invention can be varied; it has however, been shown that, on the heating to correspondingly high temperatures, binder layers are reliably removed. The heating to such high temperatures ensures, moreover that the flue gases given off are free from environmentally harmful constituents and consist essentially of nitrogen, water vapor, and carbon dioxide. Thus, the flue gas, preferably after a filtering operation, can be unhesitatingly released through chimneys, smokestacks etc. The heat exchangers 31 sand 35 ensure a desirably high degree of heat use in the arrangement so that the fuel consumption remains acceptably low and high efficacy can be achieved.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Method for the thermo-mechanical regeneration of bulk materials fed from a feeding silo, especially of foundry black sand, wherein the heating-up of the black sand that is to be regenerated is effected during its transport, through a furnace characterized by the fact that:

(a) material is heated to a temperature exceeding 500° C. in a fluidized bed furnace equipped with a forced throughput mechanism, (b) gases intended for heating as well as combustion air and/or a gas-air mixture are introduced into the fluidized bed furnace through a bottom which is porous or provided with passage openings, (c) at least the bottom of the fluidize bed furnace is made to vibrate by means of one or several vibrators into oscillations so that the material is both loosened up and guided through the furnace, in a layer of predetermined height sufficient to cause rubbing of grains against one another for mechanical cleaning, (d) the material is conducted through the heating chamber of the fluidized bed furnace by means of a forced conveying mechanism, and (e) by means of heat exchangers the flue gases of the fluidized bed furnace preheat the material that is to be fed, that the outgoing regenerated sand heats the combustion air, and that vapors arising in the feeder silo are conducted to a hearth of the fluidized bed furnace.

2. Method according to claim 1, characterized by the fact that, material is conducted through the heating chamber of the fluidized bed furnace (8) by means of a scraper conveyor.

3. Apparatus for the regeneration of bulk materials, especially of foundry black sand, comprising a fluidized bed furnace (8) having a loading end and a free end and which can be charged from a closable silo (1) with preheated bulk material, and which furnace is equipped with a forced discharge equipment which conducts the bulk material to a predetermined heating-up temperature lying above 500° C. in a predetermined layer height through the fluidized bed furnace (8) at whose free end is provided a transfer device (12) which throws the bulk material into a discharge silo (14), and wherein combustion air conducted to the fluid bed furnace (8) is forced over heat exchangers (31) provided in the discharge silo (14), and wherein flue gases developed in the fluidized bed furnace are conducted over heat exchangers (35) provided in the silo (1) to a chimney over a filtering device.

4. Apparatus according to claim 3, wherein the silo (1) which is upwardly closed through a closure (2) or through a material column, is also connected for its ventilation with the heating chamber of the fluidized bed furnace (8).

5. Apparatus according to claim 4, wherein in the lower area of the discharge silo (14) heat exchangers (39) are provided through which cooling water flows.

6. Apparatus according to claim 5, wherein heat exchangers (31, 35, 39) are developed as tubes (41) which are provided on their circumference with heat transfer sheets (42).

7. Apparatus according to claim 6, wherein said tubes are of elliptical cross-section and the greater cross-sectional axes are vertically directed.

8. Apparatus according to claim 6, wherein the several tubes (41) are connected with each other by means of joint heat transfer sheets (42).

9. Apparatus according to claim 8, wherein the bottom of the fluidized bed furnace (8) is porous or is provided with openings or nozzles, and that through these openings the combustion air as well as the heating gases and/or a gas-air mixture are conducted to the heating chamber.

10. Apparatus according to claim 9, wherein underneath the bottom (9) of the fluidized bed furnace (8) a number of chambers (32) are arranged for taking up the gases or the gas mixture.

11. Apparatus according to claim 9, wherein subsequent to the silo (1) a dosing device (3) is provided which determines the loading of the fluidized bed furnace (8).

12. Apparatus according to claim 10, wherein the fluidized bed furnace (8) has an forced conveying device or a scraper conveyor.

13. Apparatus according to claim 11, wherein at least one vibrator (11) is assigned to the fluidized bed furnace engaging at its bottom (8), which vibrator loosens up the bulk material and conducts it in longitudinal direction through the fluidized bed furnace.

14. Apparatus according to claim 12, wherein the transfer device (12) has sifters or screens which keep foreign bodies away from the discharge silo (14).

15. Apparatus according to claim 13, wherein the bottom (9) of the fluidized bed furnace (8) has at least one hold-back web (13) which is provided in its bottom area with openings (43) for the passing-through of foreign bodies.

16. Apparatus according to claim 15, wherein a feeder device (28) is provided for lumpy material, the device equipped with a material sluice.

17. Apparatus according to claim 16, wherein succeeding the discharge silo (14) a sifter (19) is arranged.

18. Apparatus according to claim 15, wherein between the discharge silo (14) and the sifter (19) a pneumatic conveyor (16) is arranged, with subsequent accelerator nozzle (18) and wherein a conveyor line (17) is directed against a baffle bell (20).

19. Apparatus according to claim 18, wherein a control device is assigned to the heat exchanger located in the lower area of the discharge silo (39) which operates according to the twopoint system, and the device being followed by a solenoid valve (38).

* * * * *